US007823621B2

(12) United States Patent
Hirata

(10) Patent No.: US 7,823,621 B2
(45) **Date of Patent: *Nov. 2, 2010**

(54) METHOD FOR MAKING FLASKLESS UPPER AND LOWER MOLDS, AN APPARATUS THEREFOR, AND A METHOD FOR PLACING A CORE

(75) Inventor: Minoru Hirata, Toyokawa (JP)

(73) Assignee: Sintokogio, Ltd., Aichi-ken (JP)

( * ) Notice: Subject to any disclaimer, the term of this patent is extended or adjusted under 35 U.S.C. 154(b) by 126 days.

This patent is subject to a terminal disclaimer.

(21) Appl. No.: 11/917,221

(22) PCT Filed: Jun. 5, 2006

(86) PCT No.: PCT/JP2006/311220

§ 371 (c)(1),
(2), (4) Date: Dec. 12, 2007

(87) PCT Pub. No.: WO2006/134798

PCT Pub. Date: Dec. 21, 2006

(65) Prior Publication Data

US 2009/0121381 A1 May 14, 2009

(30) Foreign Application Priority Data

Jun. 13, 2005 (JP) ..... 2005-172396

(51) Int. Cl.
*B22C 15/20* (2006.01)
*B22C 9/00* (2006.01)

(52) U.S. Cl. ..... 164/29; 164/21; 164/200

(58) Field of Classification Search ..... 164/29, 164/19, 20, 21, 22, 200
See application file for complete search history.

(56) References Cited

U.S. PATENT DOCUMENTS 4,463,794 A 8/1984 Shioda
5,853,042 A * 12/1998 Hunter ..... 164/456
5,927,372 A 7/1999 Moribe et al.

(Continued)

FOREIGN PATENT DOCUMENTS

EP 0 468 355 A2 1/1992

(Continued)

*Primary Examiner*—Joseph S Del Sole
*Assistant Examiner*—Jeremiah Smith
(74) *Attorney, Agent, or Firm*—Finnegan, Henderson, Farabow, Garrett & Dunner L.L.P.

(57) ABSTRACT

A method to efficiently make flaskless upper and lower molds that are stacked, to efficiently spray a release agent in a closed space, and to promptly place a core. The method includes the steps of holding a match-plate between one pair of cope and drag flasks that are horizontally positioned, each of them having a sand-filling port for supplying molding sand at its side wall, defining upper and lower molding spaces by inserting upper and lower squeeze-plates in respective openings of the pair of cope and drag flasks which openings are opposed to the match-plate, putting the pair of cope and drag flasks and the match-plate in a vertical position, and causing the sand-filling ports to be placed in an upper position, spraying a release agent into the two upper and lower molding spaces, supplying molding sand through the sand-filling ports to the two upper and lower molding spaces, and squeezing the molding sand in the two upper and lower molding spaces.

13 Claims, 4 Drawing Sheets

U.S. PATENT DOCUMENTS

| | | | | |
|---|---|---|---|---|
| 6,499,531 | B1 * | 12/2002 | Knudsen | 164/211 |
| 2007/0151694 | A1 * | 7/2007 | Hirata et al. | 164/29 |
| 2007/0175607 | A1 * | 8/2007 | Hirata et al. | 164/29 |
| 2009/0078389 | A1 * | 3/2009 | Hirata et al. | 164/29 |

FOREIGN PATENT DOCUMENTS

| | | | |
|---|---|---|---|
| JP | 62-16736 | | 4/1981 |
| JP | 04-288940 | A | 10/1992 |
| JP | 9-271897 | | 10/1997 |
| JP | 2002-336936 | A | 11/2002 |
| WO | WO 00/50187 | | 8/2000 |
| WO | WO 02/43901 | A1 | 6/2002 |

* cited by examiner

METHOD FOR MAKING FLASKLESS UPPER AND LOWER MOLDS, AN APPARATUS THEREFOR, AND A METHOD FOR PLACING A CORE

TECHNICAL FIELD

The present invention relates to an appropriate method for making flaskless upper and lower molds placed one above the other, an apparatus therefor, and a method for placing a core.

BACKGROUND OF THE INVENTION

Molding machines that make flaskless upper and lower molds are publicly known. It comprises a compressing station and a stripping station. The compressing station is placed above a base and squeezes molding sand in a direction that is horizontal and parallel to the surface of the base floor. The pulling out station is placed near the base floor and matches upper and lower molds and strips molding flasks in a direction vertical to the surface of the floor. The machine gets two pairs of cope and drag flasks to intermittently and alternately reciprocate between the compressing station and the stripping station so as to make flaskless upper and lower molds.

However, the conventional molding machine to mold flaskless upper and lower molds has a problem such as insufficient molding efficiency. Especially, a release agent is sprayed in a closed space at the final stage, and the concern has been that the release agent may not be dried sufficiently. Therefore, this is one of the reasons that the next step cannot promptly begin. Also it has been a problem that it is difficult to quickly place a core in the mold (see Japanese Patent Pablication of Examined Application No. S62-16736).

SUMMARY OF THE INVENTION

The problem to be solved by the present invention is that the conventional technology cannot efficiently make flaskless upper and lower molds or efficiently spray a release agent in a closed space, or place a core quickly.

In order to solve these problems, the method for making flaskless upper and lower molds is a method for making flaskless upper and lower molds that are stacked, that comprises the steps of holding a match-plate between a pair of cope and drag flasks that are horizontally positioned and each of them has a sand filling port for supplying molding sand at its side wall, putting the pair of cope and drag flasks and the match-plate in a vertical position, so as to place the sand filling port be in an upper position, while inserting upper and lower squeeze-plates to the respective openings of the pair of cope and drag flasks which openings are opposed to the match-plate, thereby defining two upper and lower molding spaces, spraying a release agent to the upper and lower spaces defined by inserting the upper and lower squeeze-plates to the openings, supplying molding sand through the sand filling ports to the two molding spaces, and squeezing the molding sand in the two molding spaces.

Also, in order to solve these problems, the method for making flaskless upper and lower molds is a method for making flaskess upper and lower molds which are stacked, that comprises the steps of:

holding a match-plate between a pair of cope and drag flasks that are horizontally positioned, each of them having a sand filling port at its side wall, putting the cope and drag flasks and the match-plate in a vertical position, so as to place the sand filling ports in upper position, while inserting upper and lower squeeze-plates to the respective openings of the cope and drag flasks which openings are opposed to the match-plate, thereby defining upper and lower molding spaces, spraying a release agent to the upper and lower spaces defined by inserting an upper and lower squeeze-plate to the openings, supplying molding sand through the sand filling ports to the two molding spaces, and squeezing the molding sand in the two molding spaces, Further, in order to solve these problems, the molding machine for forming flaskless upper and lower molds is an apparatus for molding flaskless upper and lower molds that are stacked, that comprises two pairs of cope and drag flask each of which has a sand filling port for supplying molding sand at its side wall, a match-plate that is arranged so as to be able to be inserted in and withdrawn from between the cope and drag flasks by a conveying mechanism for inserting and withdrawing it, a squeezing mechanism for squeezing the molding sand, wherein the match-plate is held between the cope and drag flasks, upper and lower squeeze-plates are arranged so as to be able to be inserted in and pulled out from the respective openings of the cope and drag flasks which openings are opposed to the match-plate, and the pair of cope and drag flasks and the match-plate, are held around the supporting shaft so as to be rotatable in the forward and backward directions in a vertical plane between the positions in which the molding flasks are vertical and in which they are horizontal, a rotating mechanism that rotates the squeezing mechanism in forward and backward directions, spraying mechanisms for spraying a release agent that are provided at each of the cope and drag flasks, a sand-supplying mechanism that supplies molding sand through the sand filling ports to the pair of cope and drag flasks that are positioned in a vertical position by the movement of the rotating mechanism.

Also, in order to solve these problems, the molding machine for making flaskless upper and lower molds is an apparatus for making flaskless upper and lower molds that are stacked, that comprises a unit of an cope and drag flasks in which the upper molding flask is connected with the lower one by connecting rods in a manner of moving toward or away from each other, a match-plate that is arranged so as to be able to be inserted in and withdrawn from between the cope and drag flasks of the unit by a conveying mechanism for insertion and withdrawal, spraying mechanisms for spraying a release agent that are provided at each of the cope and drag flasks, a squeezing mechanism for squeezing molding sand, wherein the unit of the cope and drag flasks is provided so as to be freely attached to and detached from each other by two or more clamping mechanisms, the match-plate is held between the cope and drag flasks, upper and lower squeeze-plates are arranged so as to be able to be inserted in and pulled out from the respective openings of the cope and drag flasks which openings are opposed to the match-plate, and the pair of cope and drag flasks, between which the match-plate is held, are held around the supporting shaft so as to be rotatable in the forward and backward directions in a vertical plane between the positions in which the molding flasks are vertical and in which they are horizontal, a rotating mechanism that rotates the squeezing mechanism in forward and backward directions, a sand-supplying mechanism that supplies molding sand through the sand filling ports to the cope and drag flasks that are placed in a vertical position by the rotating mechanism.

As in clear from the above, the methods comprise the step of putting a pair of cope and drag flasks and the match-plate in a vertical position, thereby moving the sand filling ports to an upper position, while defining upper and lower molding spaces by inserting upper and lower squeeze-plates to the respective openings of the pair of cope and drag flasks which openings are opposed to the match-plate, and the step of spraying a release agent to the two molding spaces in an upper and lower position which spaces are defined by inserting the upper and lower squeeze-plates to the openings. Thus, the release agent can be sprayed at the time or after the molding spaces are defined and before the match-plate is moved to a vertical position, and then, after the release agent is dried, the molding sand can be supplied to the spaces. Accordingly, the methods can achieve such an excellent practical effect in that they can mold flaskless upper and lower molds in a shorter period of time and more effectively than the conventional method for making a mold.

Also, the apparatuses for making flaskless upper and lower molds comprise spraying mechanisms for spraying a release agent that are provided at each of the cope and drag flasks. Therefore, the release agent can be sprayed at the time or after the molding spaces are defined and before the match-plate is in a vertical position, and then, after the release agent is dried, the molding sand can be supplied to the spaces. Accordingly, the apparatuses can achieve such an excellent practical effect in that they can mold flaskless upper and lower molds in a shorter period of time and more effectively than conventional apparatus for making a mold.

Also, the apparatus for making flaskless upper and lower molds further comprise a mechanism for stripping the upper and lower molds from the cope and drag flasks containing the molds under the condition that the molding flasks are stacked and horizontally placed, and a mechanism for swiveling molding flasks that can intermittently and alternately reciprocate two pairs of the cope and drag flasks, in which each pair of the flasks are horizontally positioned and stacked on, so that the pairs of flasks can move between the squeezing mechanism and the stripping mechanism, where the cope flask is arranged to be able to move upwardly and downwardly. Accordingly, the match-plate can be removed from between the cope and drag flasks, and the pair of the cope and drag flasks containing the molds can be detached from the match-plate. During this process, if necessary, a core can be set in the molds that have been molded and then the pair of the cope and drag flasks can be stacked on each other, and the molds can be stripped from the pair of flasks containing the molds. Therefore, the apparatuses can achieve such an excellent practical effect in that they can set a core in a shorter period of time and more effectively than the conventional method for making a mold.

Even in a single station, it further comprises a mechanism for setting a core corresponding to said each unit of cope and drag flasks. Accordingly, the method can achieve such an excellent practical effect in that they can set a core in a shorter period of time and more effectively than conventional method for setting this kind of core.

BRIEF DESCRIPTIONS OF THE DRAWINGS

DESCRIPTION OF A PREFERRED EMBODIMENT

Figure 1:
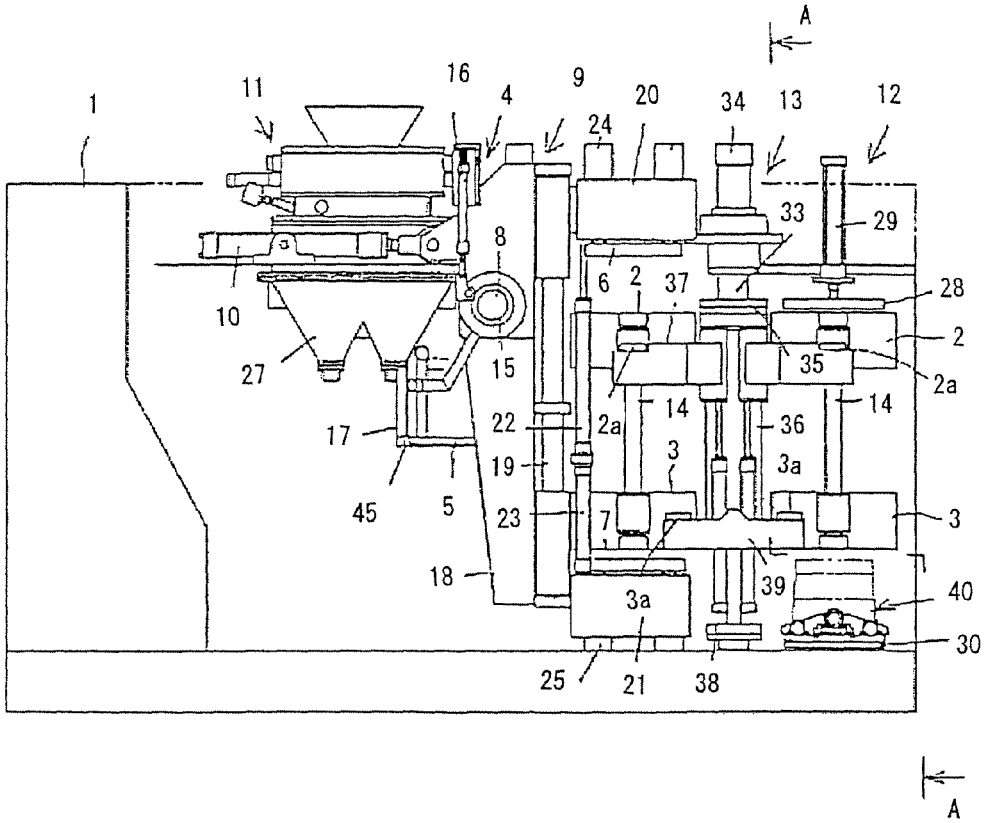
FIG. 1 is a partly cutaway front view of an embodiment of the present invention.
Figure 2:
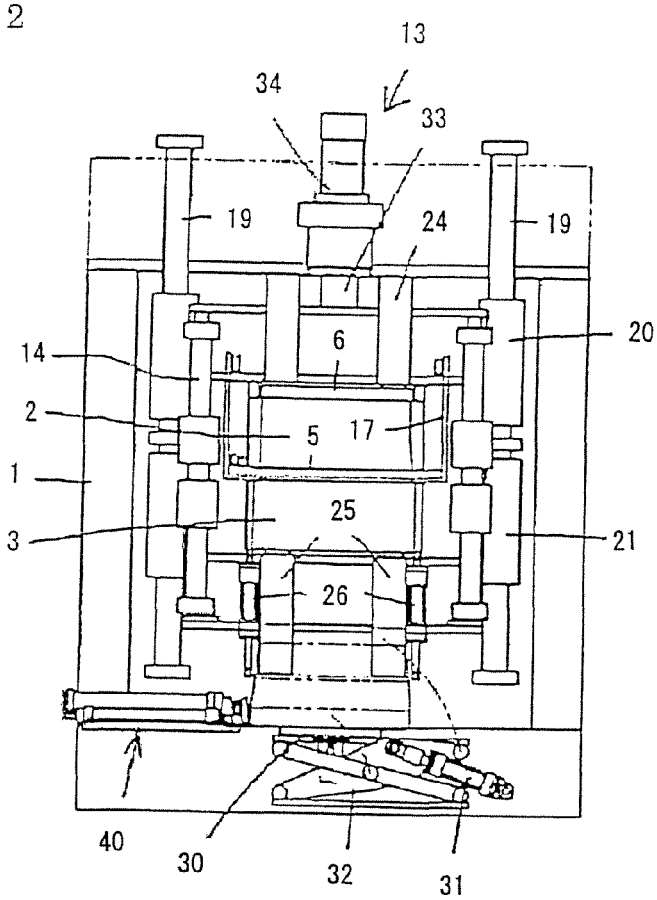
FIG. 2 is a sectional view taken along section A-A of FIG. 1, where a match-plate 5 is held between cope and drag flasks 2, 3.
Figure 3:
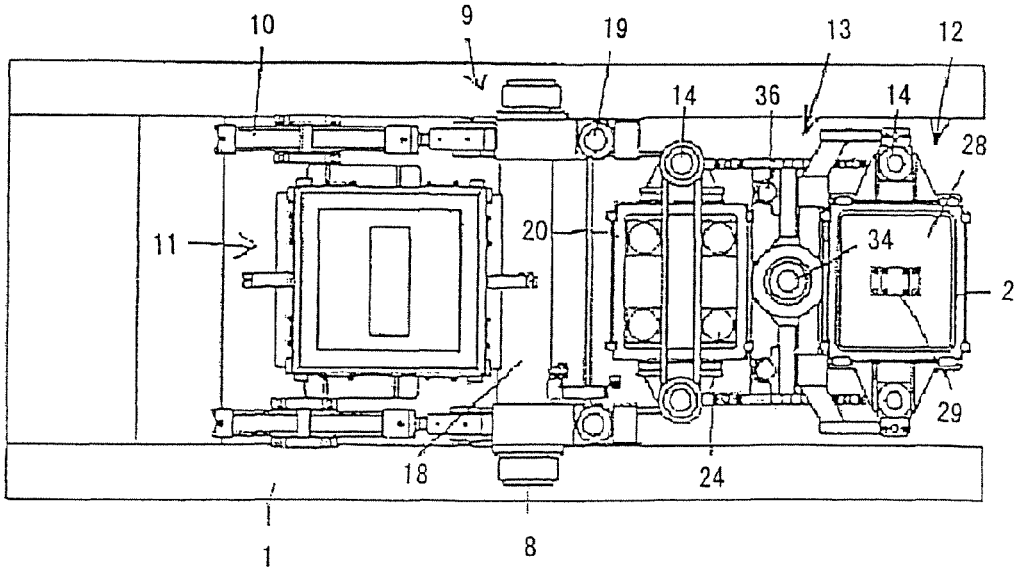
FIG. 3 is a plan view of FIG. 1.
Figure 4:
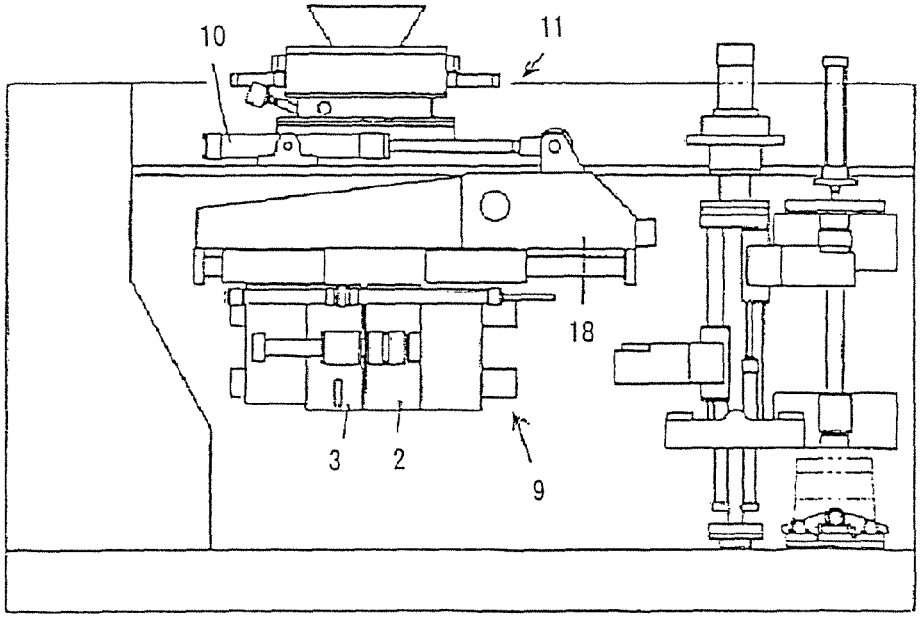
FIG. 4 is an explanatory drawing showing the process of making molds by the apparatus of FIG. 1, and showing the situation in which the molding sand is supplied to the cope and drag flasks.

In the present invention, a method for spraying a release agent in molding spaces that are defined by an cope and drag flasks, a match-plate, and an upper and lower squeeze-plates may include setting spray nozzles on the cope and drag flasks or the upper and lower squeeze-plates or both, and spraying a release agent toward the match-plate.

Also, in the present invention, whatever mechanism may be applied for setting a core, such as core-mask method, a method using a robot arm, etc.

Embodiment 1

Now, we discuss one embodiment of a molding machine of the present invention for molding flaskless upper and lower molds, referring to FIGS. 1-4. As in FIGS. 1-3, the molding machine for making flaskless upper and lower molds comprises a rectangular main frame 1 that has vacant spaces in it, two pairs of cope and drag flasks 2, 3, 2, 3, match-plate 5, a squeezing mechanism 9 for squeezing molding sand, a cylinder 10, a spraying mechanisms for spraying a release agent, a sand-supplying mechanism 11, a stripping mechanism 12 for stripping molds, and a swiveling mechanism 13 for swiveling molding flasks. Each flask of the two pairs of cope and drag flasks 2, 3, 2, 3 has a sand-filling port for supplying molding sand at its side wall. The match-plate 5 is arranged so as to be able to be inserted in and withdrawn from between one of two pairs of cope and drag molding flasks by a conveying mechanism 4 for insertion and withdrawal. The squeezing mechanism 9 holds the match-plate 5 between each pair of cope and drag flasks 2, 3, and has an upper and lower squeeze-plates 6, 7 so as to be able to be inserted in and pulled out from the openings of the molding flasks which openings are opposed to the match-plate 5, and has pairs of cope and drag flasks 2, 3 that hold the match-plate 5 so as to be rotatable in forward and backward directions around the supporting shaft 8 that is furnished in the main frame 1, in a vertical plane between the positions in which the molding flasks are vertical and in which they are horizontal. The cylinder 10 is transversally placed and rotates the squeezing mechanism 9 in forward and backward directions, as a rotating mechanism.

The release agent spraying mechanisms are provided on the cope and drag flasks 2, 3. The sand-supplying mechanism 11 supplies molding sand through the sand sand-filling ports to the pair of cope and drag flasks 2, 3 that are positioned vertically by the extension of the cylinder 10. The stripping mechanism 12 strips the upper and lower molds from the cope and drag flasks 2, 3 containing the molds, which flasks are placed horizontally and stacked on each other. The swiveling mechanism 13 can intermittently and alternately reciprocate two pairs of cope and drag flasks 2, 3, and can hook the cope flask 2, so as to be able to move it up and down in which each pair of flasks 2, 3 are horizontally positioned and stacked, so that the pairs can move between the squeezing mechanism 9 and the stripping mechanism 12.

The release agent spraying mechanisms comprises a tank for the release agent (not shown) that is mounted on the molding machine and stores the release agent, spray-nozzles (not shown) that are mounted on the pair of a cope and drag flasks 2, 3 and spray a release agent toward the match-plate 5, and pumps (not shown) that are provided near the spray-nozzle and supply the release agent to the spray-nozzles from the tank for the release agent for spraying the agent.

As for each of the cope and drag flasks 2, 3 of the two pairs of them 2, 3, 2, 3, as in FIG. 1, a pair of connecting rods 14, 14 are vertically installed on the outer surfaces of each cope flask 2 in front and in the rear. The lower molding flask 3 is slidably mounted between them. The flask 3 can be hooked at the lowest part of the pair of connecting rods 14, 14. Further, each cope flask 2 has protruding portions 2*a*, 2*a* on the center of its outer surfaces in front and in the rear. Also, each of the drag flasks 3 have protruding portions 3*a*, 3*a* on a little right side of its outer surfaces in front and in the rear when the flasks are positioned on the side of the squeezing mechanism 9.

The conveying mechanism 4 for inserting and withdrawing the match-plate 5, as in FIG. 1, comprises an annular member 15, a cylinder 16, a pair of arms 17, 17, and a carrier plate 45. The annular member 15 is fitted on the supporting shaft 8 of the squeezing mechanism 9. The cylinder 16 is connected to the sand-supplying mechanism 11 and the distal end of its piston rod is rotatably linked to a part of the annular member 15. Each of the pair of arms 17, 17 forms a cantilever, of which the proximal end is fixed to the annular member 15. The carrier plate 45 is of a suspended type and can move back and forth with the match-plate 5 on it. The pair of arms 17, 17 are swiveled up and down with the expansion and contraction of the cylinder 16. This makes the carrier plate 45 to insert and withdraw the match-plate 5 into or from between the pair of cope and drag flasks 2, 3 that are in a horizontal position, via rails 46, 47, 47, as described later. The arms 17, 17 can be connected to and disconnected from the carrier plate 45 by the movement of the arms 17, 17 that are swiveled up and down with the expansion and contraction of the cylinder 16 while the carrier plate 45 moves downwardly via the cope flask 2. The arms 17, 17 may be operated by a motor, etc., instead of a cylinder 16.

In the squeezing mechanism 9, as in FIG. 1, a rotatable frame 18 is mounted on the supporting shaft 8, which is provided on the central upper part of the main frame 1, so as to be rotatable in the forward and backward direction in a vertical plane around an axis near the center of the rotatable frame 18. The right side surface of the rotatable frame 18 has a pair of guiding rods 19, 19 that vertically extend near the front side and the rear side of the rotatable frame 18 having a certain distance therebetween. An upper lifting and lowering frame 20 that moves up and down and that has inverted L-shaped configuration is slidably mounted to and between the guiding rods 19, 19 at their upper part by holding portions that are integrated with the lifting frame 20. A lower lifting and lowering frame 21 that moves up and down and that has L-shaped configuration is slidably mounted to and between the guiding rods 19, 19 at their lower part by holding portions that are integrated with the lifting frame 21. These upper and lower lifting and lowering frames 20, 21 can be drawn close and drawn apart with the expansion and contraction of an upward-expanding cylinder 22 and a downward-expanding cylinder 23. The rotatable frame 18 has a rail 46 that guides the carrier plate 45, when the pair of cope and drag flasks 2, 3 are in a horizontal position. Also, each of the molding flasks 2, 2 has a rail 47 that guides the carrier plate 45, the level of the rail 47 being the same as that of the rail 46 when the cope flasks 2, 2 are in upper position.

The upper lifting and lowering frame 20 is equipped with two or more cylinders 24, 24 that move the upper squeeze-plate 6 backward and forward. The lower lifting and lowering frame 21 is equipped with two or more cylinders 25, 25 that move the lower squeeze-plate 7 backward and forward. The upper surface of each of the upper and lower frames 20, 21, which is plain and normal to the moving direction, has enough dimensions to push the cope and drag flasks 2, 3, respectively.

Also, the sand-supplying mechanism 11 is furnished on the left part of the ceiling of the main frame 1 in FIG. 1, and comprises two aeration tanks 27, 27. It can independently fill each of the cope and drag flasks 2, 3 with molding sand by compressed air of low pressure (aeration filling). In general, it is constructed so that the cope and drag flasks 2, 3 are filled with sand from one aeration tank. Preferably, the pressure of the compressed air of low pressure may be 0.05 MPa −0.18 MPa. The air that has a pressure lower than the atmosphere can be used together, by coupling the aeration tank with an air source of reduced pressure.

In the stripping mechanism 12, a stripping plate 28, which can be inserted into the cope and drag flasks 2, 3 that are stacked, is fixed to the lower end of the piston rod of a downward-expanding cylinder 29 that is adhered to the ceiling of the main frame 1. The stripping plate 28 can move up and down with the expansion and contraction of the cylinder 29. Also, a table 30 for receiving the upper and lower molds that are stripped from the cope and drag flasks 2, 3 is placed directly below the stripping plate 28 so as to be moved up and down. The receiving table 30 is moved up and down by a pantograph 32 that expands and contracts with the expansion and contraction of a cylinder 31, but it may be moved up and down by a lift-table that uses an ordinary cylinder as a driving source. By using this pantograph 32, any pit will not have to be prepared (see FIG. 2).

In the mechanism 13 for swiveling the flasks, a rotating shaft 33 is vertically installed in the main frame 1 so as to freely horizontally rotate. The upper end of the rotating shaft 33 is connected with the output shaft of a motor 34 that is mounted on the ceiling of the main frame 1. The rotating shaft 33 can rotate 180 degrees in forward and backward directions. A cylinder may be used instead of the motor 34. On the upper part of the rotating shaft 33, a supporting member 35 is mounted. On the supporting member 35, two pairs of guiding rods 36, 36 that extend downward and have certain distances from each other are vertically mounted. These two pairs of guiding rods 36, 36 are diagonally placed around the rotating shaft 33. On each pair of the guiding rods 36, 36, an upper hooking member 37 that hooks the protruding portions 2*a*, 2*a* of the upper molding flask 2 is mounted so as to slide upward and downward. The distal end of an upwardly directed piston rod of the cylinder 38 that is mounted on the rotating shaft 33 is fixed on each of the hooking member 37. Each of the member 37 can be moved up and down with the expansion and contraction of the cylinder 38. Also, on the lower end of each pair of the guiding rods 36, 36, a lower hooking member 39 that hooks the protruding portions 3*a*, 3*a* of two of the drag flasks 3, 3 is provided.

The number 40 in the drawings denotes an apparatus that takes out upper and lower molds that are stripped from the cope and drag flasks 2, 3, and placed on a receiving table 30.

Now, we discuss a procedure for making flaskless upper and lower molds from the condition of FIG. 1, using the machine for making flaskless upper and lower molds. First, the match-plate 5 is inserted between cope and drag flasks 2, 3 that are in a horizontal position, by the arm 17, 17 with the expansion and contraction of the cylinder 16 of the conveying mechanism 4.

Then, by contracting of the upwardly directed cylinder 22 and the downwardly directed cylinder 23 of the squeezing mechanism 9 causes the cope and drag flasks 2, 3 to move toward each other via the upper and lower lifting frames 20, 21. While the molding flasks 2, 3 hold the match-plate 5, the expansion of the plural cylinders 24, 24, 25, 25 of the squeezing mechanism 9 causes the upper squeeze-plate 6 and lower squeeze-plate 7 to be inserted in predetermined length into the molding flasks 2, 3, thereby defining upper and lower molding spaces. Maintaining the molding spaces, the expansion of the cylinder 10 causes the squeezing mechanism 9 to rotate clockwise around the supporting shaft 8, and accordingly the pair of molding flasks 2, 3 and the match-plate 5 are put in a vertical position and the sand sand-filling ports are put in a upper position. Further, the sand-filling ports are made to come into contact with the lower ends of the two aeration tanks 27, 27 of the sand-supplying mechanism 11 (see FIG. 4). Each of the cylinders 24, 24, 25, 25 may be a combination of a cylinder of large bore and a guide pin.

In the periods from the time that the upper and lower molding spaces are defined to the time that the sand-filling ports are in contact with the lower ends of the sand-supplying mechanism 11, the release agent is sprayed onto the match-plate 5 through the spraynozzles that are mounted on the cope and drag flasks 2, 3. The timing of the spraying may be after the molding flask 2, 3 and the match-plate 5 are put in a vertical position, or while the molding flasks 2, 3 and the match-plate 5 are moved from a horizontal position to a vertical position. Also, as for the order of spraying of the release agent, it may be sprayed onto the side of the lower molding space after being sprayed onto the side of the upper molding space, or sprayed onto the sides of the upper and lower spaces at the same time.

Then, the sand-supplying mechanism 11 supplies molding sand into the upper and lower molding spaces. Next, while the pair of cope and drag flasks 2, 3 and the match-plate 5 are returning to the horizontal position, the molding sand in the upper and lower molding spaces is squeezed by moving the upper and lower squeeze-plates 6, 7 forward. Then, the upward-expanding cylinder 22 and the downward-expanding cylinder 23 are expanded and the upper and lower lifting and lowering frames 20, 21 are drawn apart from each other.

Next, the cylinder 38 in the mechanism 13 for swiveling the molding flasks is expanded and the upper flask 2 containing the mold that is made by squeezing the molding sand is lifted by the upper hooking member 37 and separated from the match-plate 5. The drag flask 3 is put on the lower hooking member 39 of the swiveling mechanism 13. Then, the cylinder 16 is contracted and the arms 17, 17 withdraw the match-plate 5 from between the cope and drag molding flasks 2, 3. Next, the motor 34 of the swiveling mechanism 13 rotates the rotating shaft 33 in a required degree of angle and causes the cope and drag flasks 2, 3 containing the molds to move to a position that is in line with the stripping mechanism 12. Then, if required, after setting a core in the mold, the cylinder 38 is contracted and lowers the upper flask 2 containing the mold and places it on top of the lower flask 3 via upper hooking member 37.

Next, the cylinder 31 of the stripping mechanism 12 is expanded, the table 30 for receiving molds is raised, and the cope and drag flask 2, 3 that contains the molds are put on the receiving table 30. Then, the cylinder 29 of the stripping mechanism 12 is expanded and causes the stripping plate 28 to contact the mold in the cope flask 2. After that, the cylinder 31 is contracted, the stripping plate 28 and the receiving table 30 are simultaneously lowered, and the molds are stripped from the cope and drag flask 2, 3. Then, the apparatus 40 for pushing out molds pushes out the upper and lower molds on the table 30.

In the above procedure, before moving the cope and drag flasks 2, 3 containing the molds to a position in line with the stripping mechanism 12, if necessary, the core may be set in the molds, which have previously been formed using a mechanism for setting a core (not shown) or by hand. Then, as above explained, a pair of molding flask 2, 3 that contain molds are stacked, and then the molds may be stripped.

Embodiment 2

Figure 5:
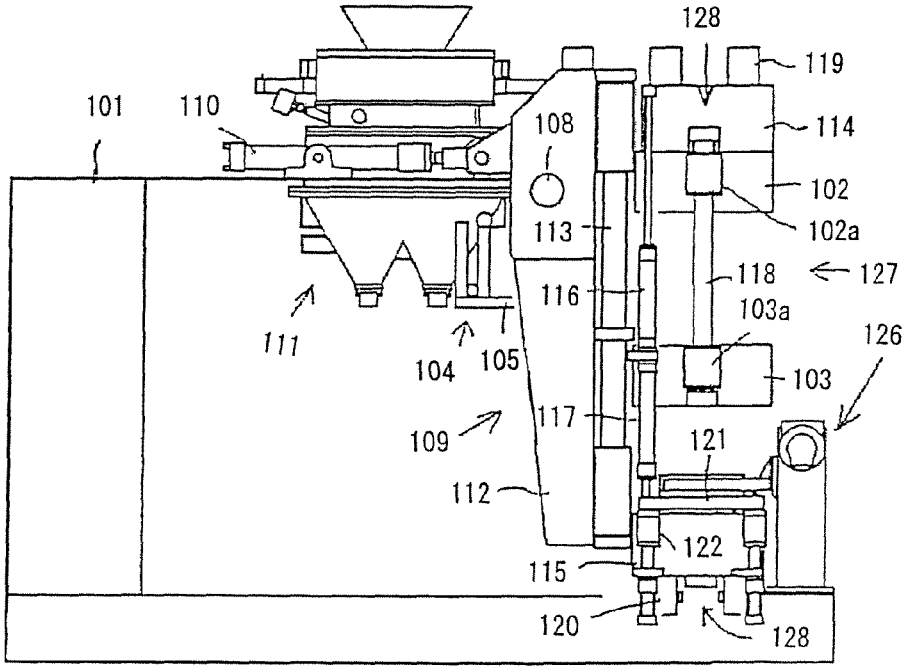
FIG. 5 is a front view of another embodiment of the present invention.
Figure 6:
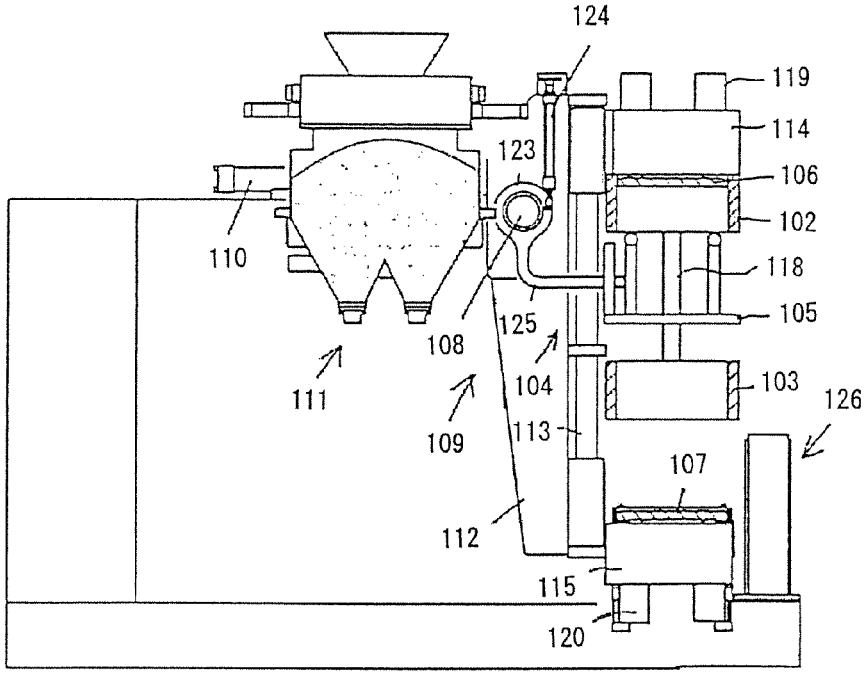
FIG. 6 is a partly cutaway sectional front view of FIG. 5.
Figure 7:
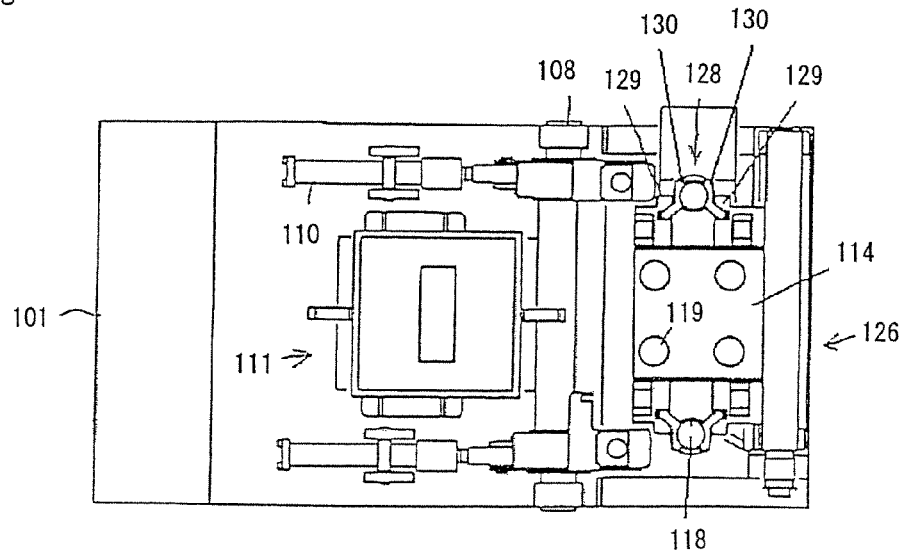
FIG. 7 is a partly cutaway sectional plan view of FIG. 5.

Now, we discuss another embodiment of the molding machine of the present invention for making flaskless upper and lower molds, referring to FIGS. 5-7. As in FIGS. 5-7, the molding machine for molding flaskless molds comprises the main frame 101 that has vacant spaces in it, a unit of a cope and drag flasks 127, match-plate 105, a squeezing mechanism 109 for squeezing molding sand, two cylinders 110, a release agent spraying mechanisms, and a sand-supplying mechanism 111. The unit of cope and drag flasks 127 is constructed such that the upper molding flask 102 is connected with the lower one 103 by a pair of connecting rods 118, 118 such that they can freely move forward and away from each other. The match-plate 5 is arranged so as to be able to be inserted in and withdrawn from the gap between the cope and drag flasks 102, 103 by a conveying mechanism 104 for insertion and withdrawal. The squeezing mechanism 109 has a unit of cope and drag flasks 127 so as to be freely attached and detached by a pair of clamping mechanisms 128, 128, holds a match-plate 105 between the cope and drag flasks 102, 103, has an upper and lower squeeze-plates 106, 107 so as to be able to be inserted in and pulled out of the openings of the molding flasks which openings are opposed to the match-plate 105, and has the cope and drag flasks 102, 103 that hold the match-plate 105 so as to be rotatable in the forward and backward directions around the supporting shaft 108 that is furnished in a central upper part of the main frame 101 in a vertical plane between the positions in which the molding flasks are vertical and in which they are horizontal. The cylinders 110 are transversely placed and rotate the mechanism 109 for squeezing molding sand in forward and backward directions. The release agent spraying mechanisms are provided on the cope and drag flasks 102, 103. The sand-supplying mechanism 111 supplies molding sand through the sand-filling ports to the molding flasks 102, 103 that are positioned vertically by the extension of the cylinders 110, 110. The release agent spraying mechanisms comprise a tank for the release agent (not shown) that is mounted on the molding machine and stores the release agent, spray-nozzles (not shown) that are mounted on the pair of cope and drag flasks 102, 103 and spray the release agent onto the match-plate 105, and release agent pumps (not shown) that are provided near the spray-nozzle and supply the release agent to spray-nozzles from the tank of the release agent and cause the spray nozzles to spray with it.

As for the unit of cope and drag flasks 127, as shown in FIG. 5, on each of front and rear outer surfaces of each of the cope and drag flasks 102, 103 is provided a projection 102*a*, 103*b*, each forming a through hole between it and the body of the flasks 102, 103 so that a connecting rod 118 is made to slide in each hole. Also, the lower molding flask 103 is made to contact the upper molding flask 102 via the connecting rods 118, 118 and is suspended from the upper flask. Also, the lower flask 103 is arranged so that it can move downward a required length. Further, upper and lower parts of the connecting rods 118, 118 each have a notch so as to engage with a claw 130 in the clamping mechanisms 128, 128, as described later.

The clamping mechanism 128, as shown in FIG. 7, is mounted on each of the front and back surfaces of a upper lifting and lowering frame 114. Also, it has a pair of swing-motors 129, 129, and a claw 130 that is engaged with each shaft of the swing-motors 129, 129. With the action of the swing-motors 129, 129, the pair of claws 130, 130 move into the upper notches of the connecting rods 118, 118 of the unit of an cope and drag molding flasks 127 so as to hold the upper parts of the rods.

A clamping mechanism 128, is also mounted on each of the front and back, surface of a lower lifting and lowering frame 115, as described later. It moves into a lower notch of each of the connecting rods 118, 118 so as to hold the lower parts of the rods.

In the squeezing mechanism 109, as shown in FIGS. 5 and 6, a rotatable frame 112 is mounted on the supporting shaft 108 so as to be rotatable in the forward and backward direction in a vertical plane around an axis near the center of the rotatable frame. The right side surface of the rotatable frame 112 in FIG. 5 has a pair of guiding rods 113, 113 that vertically extend near the front side and the rear side of the rotatable frame 112, having a certain distance therebetween. The upper lifting and lowering frame 114 that moves up and down and that has inverted L-shaped configuration is slidably mounted to and between the guiding rods 113, 113 at their upper part via holding portions that are integrated with the frame 114. The lower lifting and lowering frame 115 that moves up and down and that has L-shaped configuration is slidably mounted to and between the guiding rods 113, 113 at their lower part via holding portions that are integrated with the frame 105. These upper and lower frames 114, 115 can be moved toward and away from each other with the expansion and contraction of an upward-expanding cylinder 116 and a downward-expanding cylinder 117.

The upper lifting and lowering frame 114 that moves up and down is equipped with two or more cylinders 119, 119 that move the upper squeeze-plate 106 backward and forward. The lower lifting and lowering frame 115 is equipped with two or more cylinders 120, 120 that move the lower squeeze-plate 107 backward and forward. The upper surface of each of the upper and lower frames 114, 115, which has a plain surface, has enough dimensions to push each of the cope and drag flasks 102, 103. Also, upward-expanding cylinders 122, 122 are mounted on the front and back, outer surface of the lower lifting and lowering frame 115. Further, a leveling frame 121, which is shaped a square and slidably fitted on the lower-squeeze plate 107, is fixed on the upper ends of the upward-expanding cylinders 122, 122.

The conveying mechanism 104 for inserting and withdrawing the match-plate 105, as shown in FIGS. 5 and 6, comprises an annular member 123, a cylinder 124, a pair of arms 125, 125, and a carrier plate (not shown). The annular member 123 is fitted on the supporting shaft 108 of the mechanism 109 for squeezing molding sand. The cylinder 124 is connected to the rotatable frame 112 and the distal end of its piston rod is rotatably fitted with a part of the annular member 123. Each of the arms 125, 125 has a cantilever structure and its proximal end is fixed on the annular member 123. The carrier plate is a suspended type and can move back and forth with the match-plate 105 on it. The pair of arms 125, 125 are swiveled up and down with the expansion and contraction of the cylinder 124. This makes the carrier plate to insert and withdraw the match-plate 105 between the pair of cope and drag flasks 102, 103 that are in a horizontal position. The arms 125, 125 may be operated by a motor, etc., instead of a cylinder 124.

Also, the sand-supplying mechanism 111 is furnished on the left part of the ceiling of the main frame 101 in FIG. 5, and comprises two aeration tanks (not shown). It can independently fill each of the cope and drag flasks 102, 103 with molding sand by compressed air of low pressure. In general, it is constructed so that the cope and drag flasks 102, 103 are filled with sand from one aeration tank. Preferably, the pressure of the compressed air of low pressure may be 0.05 MPa-0.18 MPa.

The reference number 126 in the drawings denotes an apparatus that takes out an upper and lower molds that are stripped from the cope and drag flasks 102, 103, and places them on a receiving table.

If necessary, a core may be set in a mold using a mechanism for setting a core (not shown) or by hand. Then, a pair of the molding flasks 102, 103 that have contain molds are stacked, and then the molds may be stripped.

What is claimed is:

1. A method for making flaskless upper and lower molds that are stacked using two pairs of cope and drag flasks, comprising the steps of providing two pairs of cope and drag flasks, holding a match-plate between one pair of the two pairs of cope and drag flasks that are in a horizontal position, each of them having a sand-filling port at a side wall thereof, defining upper and lower molding spaces by inserting upper and lower squeeze-plates into respective openings of the one pair of cope and drag flasks, which openings are opposed to the match-plate, moving the one pair of cope and drag flasks and the match-plate to a vertical position, and causing the sand filling ports to be placed in an upper position, spraying a release agent into the upper and lower molding spaces, supplying molding sand through the sand-filling ports to the upper and lower molding spaces, squeezing the molding sand in the upper and lower molding spaces to form upper and lower molds therein, and returning the one pair of cope and drag flasks to the horizontal position, wherein the step of squeezing the molding sand in the upper and lower molding spaces is carried out by moving the upper and lower squeeze-plates toward each other, while the one pair of cope and drag flasks and the match-plate are returning to the horizontal position.

2. The method for making flaskless upper and lower molds of claim 1, wherein after defining the upper and lower molding spaces by inserting the upper and lower squeeze-plates into the respective openings of the one pair of cope and drag flasks, the one pair of cope and drag flasks are rotated to put the one pair of cope and drag flasks and the match-plate in the vertical position and the sand-filling ports in the upper position.

3. The method for making flaskless upper and lower molds of claim 1, wherein the release agent is sprayed into the lower molding space after the release agent is sprayed into the upper molding space.

4. The method for making flaskess upper and lower molds of claim 1, further comprising the steps of causing the one pair of cope and drag flasks containing the upper and lower molds to be detached from the match-plate, and withdrawing the match-plate from between the one pair of cope and drag flasks after the one pair of cope and drag flasks has been returned to the horizontal position, moving the one pair of cope and drag flasks from the horizontal position to a stripping position while simultaneously moving the other of said two pairs of cope and drag flasks to the horizontal position, stacking the one pair of cope and drag flasks in the stripping position and, if necessary, after setting a core in the meld molds that have been formed, and stripping stacked upper and lower molds from the one pair of melding stacked cope and drag flasks containing the molds at the stripping position.

5. A method for making flaskless upper and lower molds that are stacked using one pair of cope and drag flasks, comprising the steps of providing a pair of cope and drag flasks, holding a match-plate between the pair of cope and drag flasks that are in a horizontal position, each of them having a sand-filling port for supplying molding sand at a side wall thereof, defining upper and lower molding spaces by inserting upper and lower squeeze-plates into respective openings of the pair of cope and drag flasks, which openings are opposed to the match-plate, moving the pair of cope and drag flasks and the match-plate to a vertical position, and causing the sand-filling ports to be in an upper position, spraying a release agent into the upper and lower molding spaces, supplying molding sand through the sand-filling ports to the upper and lower molding spaces, squeezing the molding sand in the upper and lower molding spaces to form upper and lower molds therein, and returning the pair of cope and drag flasks to the horizontal position, wherein the step of squeezing the molding sand in the upper and lower molding spaces is carried out by moving the upper and lower squeeze-plates toward each other while the pair of cope and drag flasks and the match-plate are returning to the horizontal position.

6. The method for making flaskless upper and lower molds of claim 5, wherein after defining the upper and lower molding spaces by inserting the upper and lower squeeze-plate into the respective openings of the pair of cope and drag flasks, the pair of cope and drag flasks are rotated to put the pair of cope and drag flasks and the match-plate in the vertical position and the sand-filling ports in the upper position.

7. The method for making flaskless upper and lower molds of claim 5, wherein the release agent is sprayed into the lower molding space after the release agent is sprayed into the upper molding space.

8. The method of claim 1, wherein the upper and lower molding spaces are defined by inserting the upper and lower squeeze-plates into the respective openings of the one pair of cope and drag flasks at the same time as the one pair of cope and drag flasks are being moved to the vertical position.

9. The method of claim 1, wherein the release agent is sprayed into the upper and lower molding spaces and toward the match-plate after the one pair of cope and drag flasks have been moved to the vertical position and before the molding sand is supplied to the upper and lower molding spaces.

10. The method of claim 1, wherein the release agent is sprayed into the upper and lower molding spaces and toward the match-plate while the one pair of cope and drag flasks are being moved to the vertical position.

11. The method of claim 5, wherein the upper and lower molding spaces are defined by inserting the upper and lower squeeze-plates into the respective openings of the pair of cope and drag flasks at the same time as the pair of cope and drag flask are being moved to the vertical position.

12. The method of claim 5, wherein the release agent is sprayed into the upper and lower molding spaces and toward the match-plate after the pair of cope and drag flasks are in the vertical position and before the molding sand is supplied to the upper and lower molding spaces.

13. The method of claim 5, wherein the release agent is sprayed-into the upper and lower molding spaces and toward the match-plate while the pair of cope and drag flasks are being moved to the vertical position.

* * * * *